US005697112A

United States Patent [19]

Colavito et al.

[11] Patent Number: 5,697,112

[45] Date of Patent: Dec. 16, 1997

[54] THERAPY PILLOW USEFUL FOR TREATING GASTROESOPHAGEAL REFLUX DISEASE (GERD) AND OTHER APPLICATIONS

[75] Inventors: Barbara J. Colavito, Durham; Pieter Muntendam, Raleigh, both of N.C.

[73] Assignee: Glaxo Wellcome Inc., Research Triangle Park, N.C.

[21] Appl. No.: 745,566

[22] Filed: Nov. 8, 1996

[51] Int. Cl.[6] ..... A47C 20/00

[52] U.S. Cl. ..... 5/633; 5/655.5; 5/657; 5/490

[58] Field of Search ..... 5/630, 633, 644, 5/652, 655.5, 655.9, 657, 490

[56] References Cited

U.S. PATENT DOCUMENTS

| | | | |
|---|---|---|---|
| 2,612,645 | 10/1952 | Boland | 5/341 |
| 3,389,411 | 6/1968 | Emery | 5/490 |
| 3,600,726 | 8/1971 | Williams | 5/655.5 X |
| 3,644,949 | 2/1972 | Diamond | 5/338 |
| 3,795,021 | 3/1974 | Moniot | 5/341 |
| 3,900,910 | 8/1975 | Nakata | 5/341 |
| 4,143,909 | 3/1979 | McFarlin | 5/655.5 |
| 4,193,150 | 3/1980 | Vineberg | 5/655.9 X |
| 4,528,705 | 7/1985 | Greenawalt | 5/441 |
| 4,660,238 | 4/1987 | Jay | 5/655.5 X |
| 4,753,705 | 6/1988 | Poncy | 5/655.5 X |
| 4,783,866 | 11/1988 | Simmons et al. | 5/441 |
| 4,803,743 | 2/1989 | Greenawelt | 5/434 |
| 4,805,603 | 2/1989 | Cumberland | 128/75 |
| 4,847,931 | 7/1989 | Bard | 5/441 |
| 4,896,388 | 1/1990 | Bard | 5/441 |
| 4,916,765 | 4/1990 | Castronovo, Jr. | 5/437 |
| 4,928,336 | 5/1990 | Petillo, Sr. | 5/441 |
| 4,932,089 | 6/1990 | Laviero | 5/421 |
| 4,959,880 | 10/1990 | Tesch | 5/434 |
| 5,168,590 | 12/1992 | O'Sullivan | 5/490 |
| 5,231,720 | 8/1993 | Benoff | 5/644 |
| 5,432,967 | 7/1995 | Raftery | 5/633 |
| 5,449,790 | 9/1995 | Saro et al. | 5/657 |

OTHER PUBLICATIONS

Brochure by Hudson "The Science of Sleep".

Brochure by Empire Medical Concepts, Inc.

Publication by John W. Hamilton, et al. in *Digestive Diseases and Science* ; vol. 33, No. 5 (May, 1988) pp. 518–522 "Sleeping on a Wedge Diminishes Exposure of the Esophagus to Refluxed Aci".

Publication by Hudson Industries, Inc. "Therapeutic Water Pillow".

Publication By Hudson Industries, Inc. "Therapeutic Air Pillow".

Brochure by Hudson Medical Products "The Single Soure For Home Healthcare Foam Products".

*Primary Examiner*—Michael F. Trettel

*Attorney, Agent, or Firm*—Charles E. Dadswell

[57] ABSTRACT

A therapy pillow comprising a wedge-shaped resilient foam element having a planar recess in the medial portion of the top surface thereof. A flexible plastic container adapted to be sealingly filled with a fluid snugly fits into the planar recess of the foam element so as to be substantially coplanar with the top surface thereof when filled with a suitable fluid such as water.

10 Claims, 3 Drawing Sheets

THERAPY PILLOW USEFUL FOR TREATING GASTROESOPHAGEAL REFLUX DISEASE (GERD) AND OTHER APPLICATIONS

TECHNICAL FIELD

The present invention relates to supportive pillows, and more particularly relates to a therapy pillow useful for treating symptoms of gastroesophageal reflux disease (GERD) and for other applications.

RELATED ART

Gastroesophageal reflux disease (GERD) is a well known problem encountered by physicians in most medical specialties. The disease encompasses a broad range of clinical presentations, with no consistent relationship between subjective complaints and objective findings. Some degree of gastroesophageal reflux occurs in normal people, and should be considered a benign physiologic process. The term gastroesophageal reflux disease (GERD) is best defined as including symptoms and/or evidence of tissue damage secondary to reflux of gastric contents.

The varied manifestations of gastroesophageal reflux disease (GERD) may obscure its underlying cause and make it very difficult to diagnose and treat. Chronic reflux has been implicated in the cause of non-cardiac chest pain as well as disorders of the pharynx, larynx and respiratory tract. About half of adult asthmatics may also have gastroesophageal reflux disease (GERD) that tends to contribute to their asthma. Also, gastroesophageal reflux disease (GERD) is probably involved in a variety of well known pulmonary diseases.

Most individuals with gastroesophageal reflux disease (GERD) symptoms are not seen by physicians and tend to live with their discomfort. A smaller group of individuals will persistent symptoms of GERD without complications are likely to occasionally seek medical attention from their physicians. Individuals with chronic GERD symptoms and significant complications from their disease represent only a small percentage of patients with gastroesophageal reflux disease. Although in the last few years very potent and effective acid suppressing medications have been used in the treatment of GERD, the older more conservative empiric therapies are still believed to offer a high degree of efficacy in the treatment of GERD.

For example, current belief is that postural therapy by elevation of the head of a patient's bed is quite effective in the treatment of GERD. This has traditionally been accomplished by raising the head of the bed frame on blocks, but this has been found to be disadvantageous in that it affects the sleeping habits of the spouse and both the patient and spouse tend to slide to an uncomfortable position at the end of the bed. Also, some sufferers of GERD have in the past used a foam wedge or multiple pillows in order to elevate their upper body in a raised position during sleep to decrease esophageal acid exposure. Although sleeping on a foam wedge is known to produce a significant decrease in the distal esophageal acid exposure, foam wedges known in the prior art have been discovered to result in neck and back stiffness and/or discomfort particularly if the user has a history of chronic low back pain.

Thus, applicant's inventive therapy pillow meets the long-felt need for an improved wedge pillow for use to elevate the upper body of GERD sufferers during sleeping without resulting in the neck and back stiffness resulting from previously known foam wedge pillows which may result in better patient compliance. Applicant's novel and improved therapy pillow provides for even weight distribution by providing a fluid-filled container within a recess in the top surface of the therapy pillow that results in more even weight distribution and significant enhancement in overall comfort by the user.

DISCLOSURE OF THE INVENTION

In accordance with the present invention, applicant provides a novel and improved therapy pillow that is particularly useful for treating gastroesophageal reflux disease (GERD) but that can be used for many other applications as a matter of user choice. The therapy pillow comprises a wedge-shaped resilient foam element having a top and a bottom surface and a relatively elevated upper first end and a relatively lower second end. The wedge-shaped resilient foam element defines a planar recess in the medial portion of the top surface thereof. The therapy pillow also includes a flexible plastic container shaped to snugly fit into the planar recess of the foam element so as to be substantially coplanar with the top surface of the foam element, and the container is further adapted to sealably receive a fluid such as water therein. In this fashion, the fluid-filled plastic container serves to distribute weight evenly and to minimize or obviate the neck and back stiffness of a patient sleeping on the therapy pillow of the invention. The personal bed pillow to support the head may be used on top of the therapy pillow.

Therefore, it is an object of the present invention to provide an improved therapy pillow particularly useful for treating gastroesophageal reflux disease (GERD) by acting to distribute weight more evenly so as to minimize neck and back stiffness normally associated with foam wedge pillows.

It is another object of the present invention to provide an improved therapy pillow designed to provide proper elevation of the upper body during sleep that is particularly helpful for treating gastroesophageal reflux disease (GERD) but that can be used in other applications as desired by the user.

It is still another object of the present invention to provide an improved therapy pillow having a fluid-filled flexible plastic container provided in the medial portion of the top surface area thereof that acts to efficiently and evenly distribute weight in a manner similar to a waterbed.

Some of the objects of the invention having been stated, other objects will become evident as the description proceeds, when taken in connection with the accompanying drawings described hereinbelow.

DETAILED DESCRIPTION OF THE INVENTION

The improved therapy pillow of the invention essentially comprises a wedge-shaped resilient foam element having a fluid-filled flexible plastic container fitted into a recess in the top surface thereof so as to be substantially coplanar (when fluid filled) with the top surface of the wedge-shaped resilient foam element.

The flexible plastic container is preferably filled with water and is a particularly desirable feature since it allows the user to more comfortably rest their upper body on the therapy pillow due to the even weight distribution that serves to substantially obviate neck and back stiffness associated with wedge-shaped foam pillows known heretofore. Although the therapy pillow is useful for many applications, applicant contemplates that it has particular efficacy for treating gastroesophageal reflux disease (GERD).

The therapy pillow of the present invention will now be described with reference to FIGS. 1–5 of the drawings.

FIGS. 1–5 show novel therapy pillow 10 of the invention. Therapy pillow 10 is formed from resilient foam element 12 that defines a wedge shape. Although applicant believes that many different types of foam materials may be utilized to form wedge-shaped resilient foam element 12, applicant has discovered that conventional polyurethane foam is a particularly advantageous construction material. Foam element 12 includes planar recessed area 14 in the medial portion of the top surface thereof.

Figure 1:
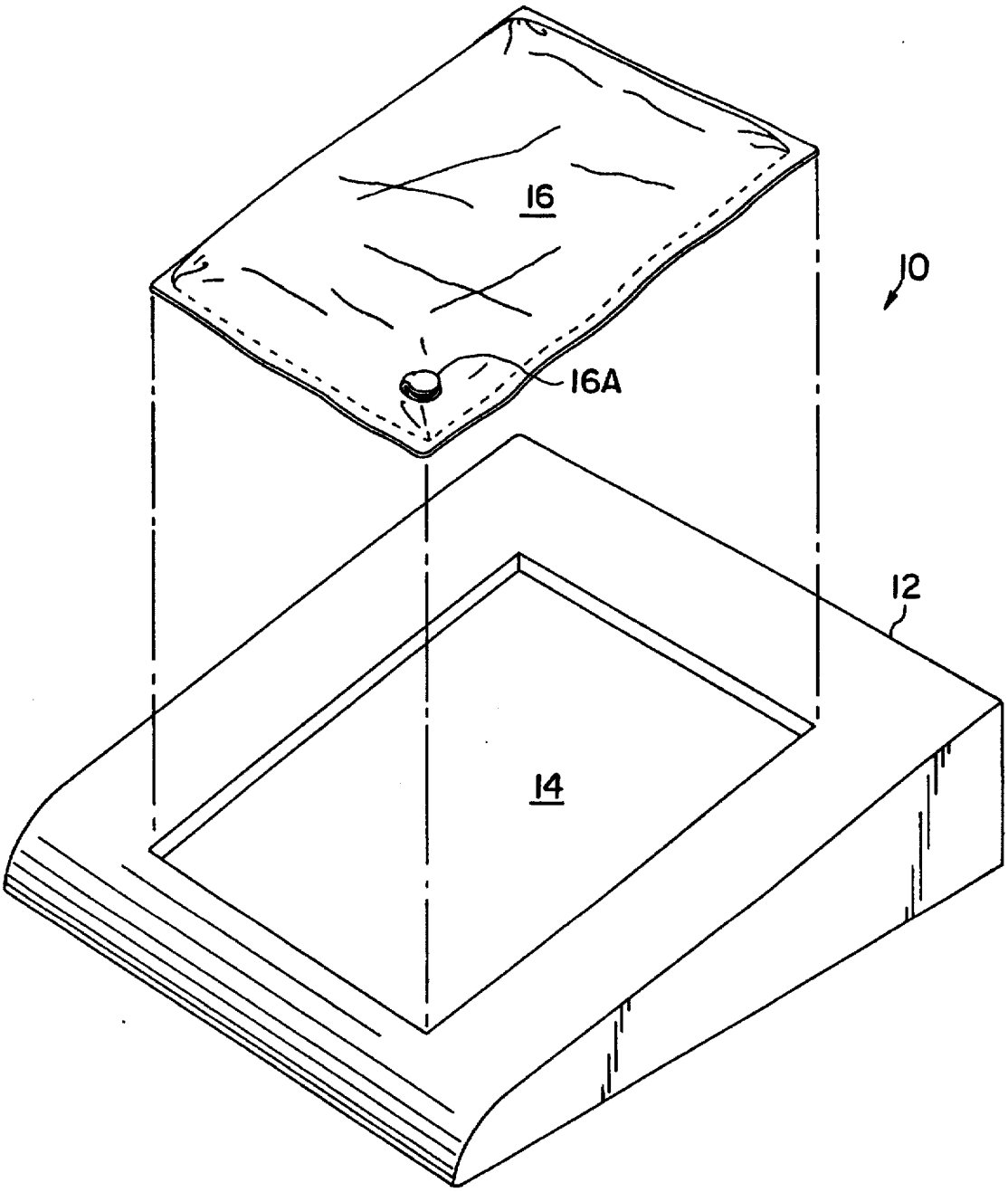
FIG. 1 is a perspective view of the therapy pillow of the invention with the flexible plastic container removed therefrom to show the planar recess into which it snugly fits.
Figure 2:
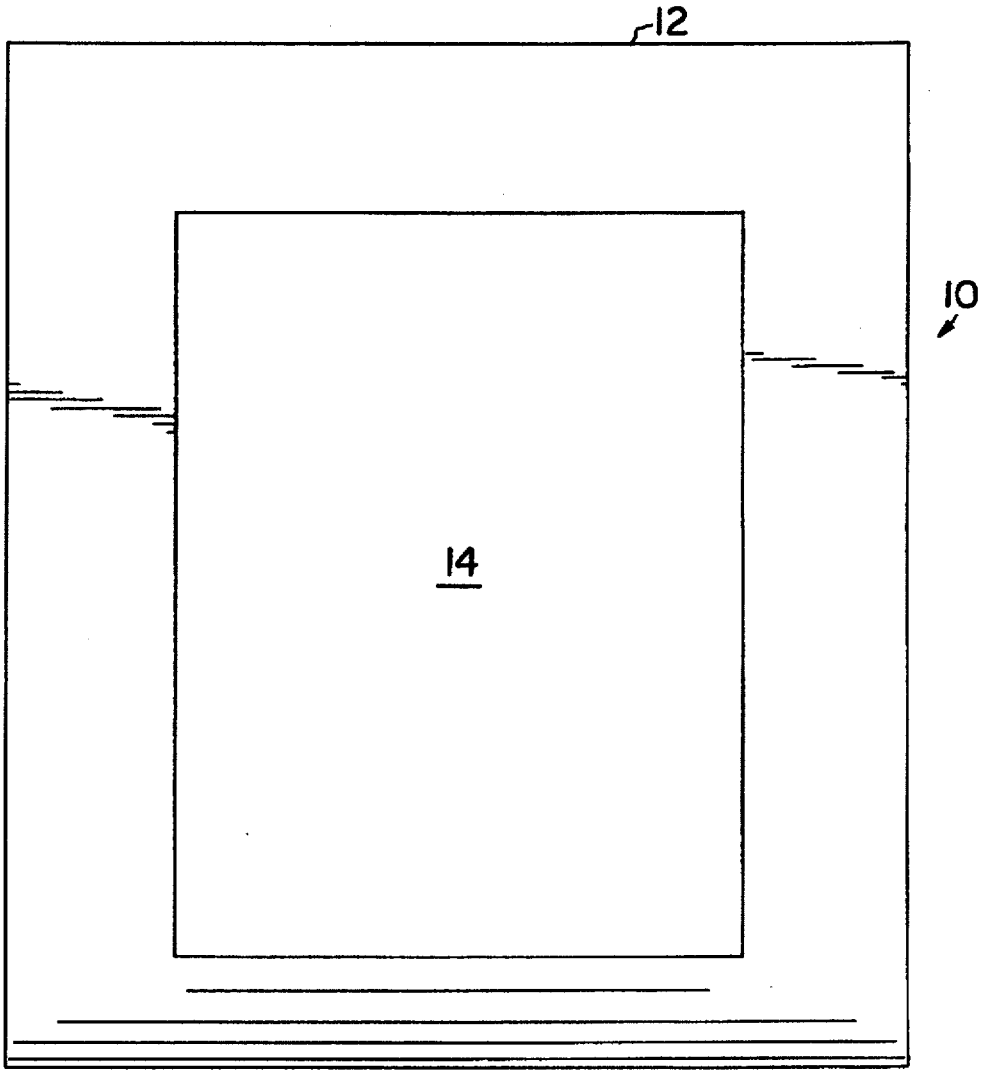
FIG. 2 is a top plan view of the therapy pillow of the invention with the plastic container removed therefrom.
Figure 3:
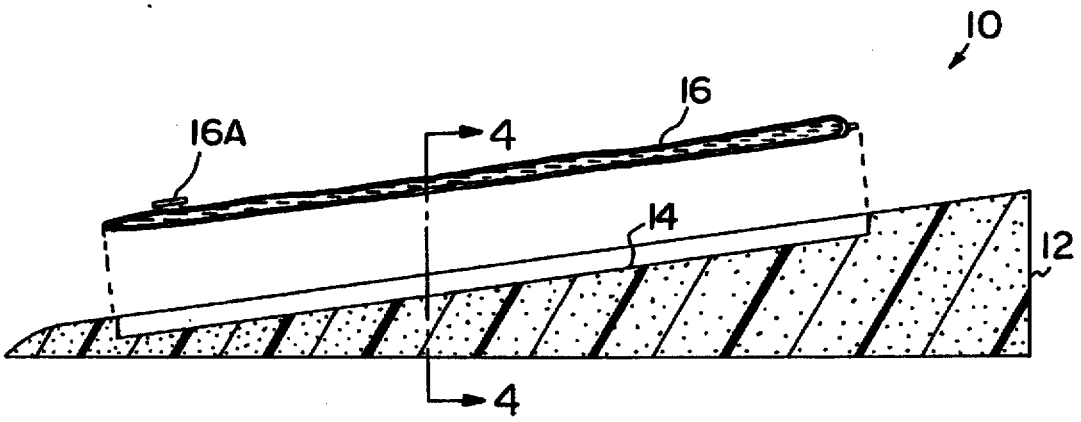
FIG. 3 is a vertical cross-sectional view of the therapy pillow of the present invention.
Figure 4:
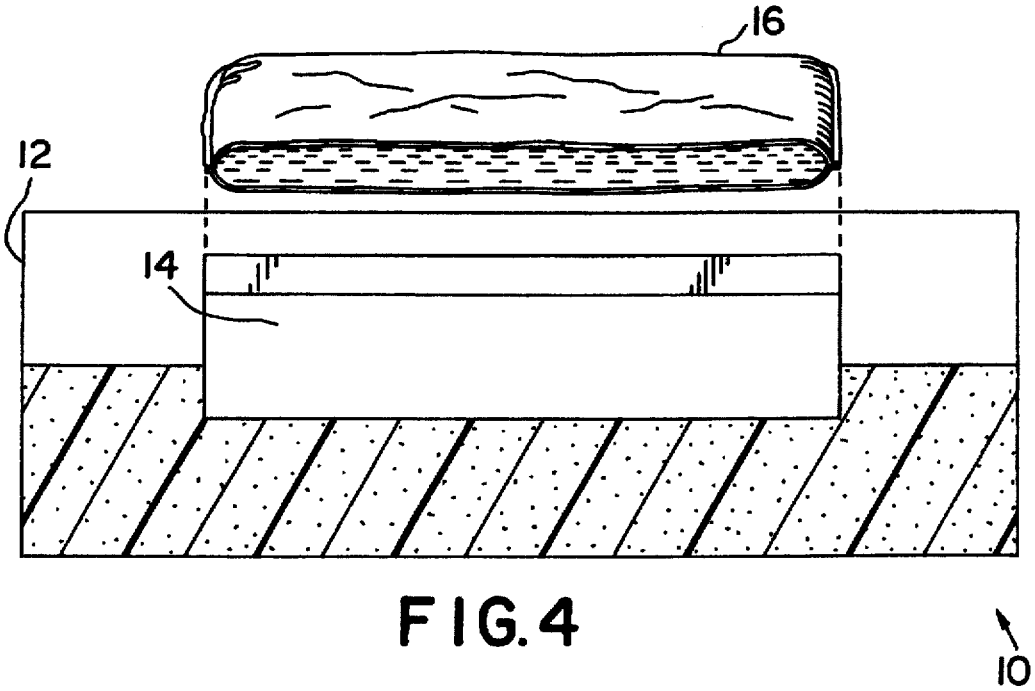
FIG. 4 is a transverse cross-sectional view of the therapy pillow of the invention taken along the lines 4—4 of FIG. 3.
Figure 5:
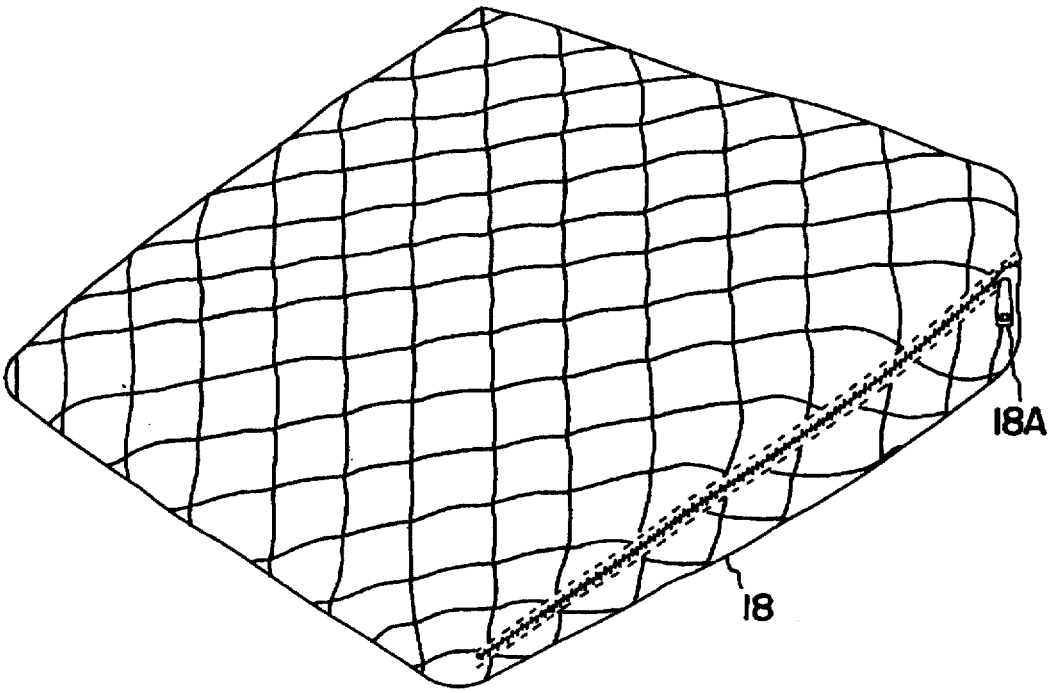
FIG. 5 is a perspective view of a zippered protective cover into which the novel therapy pillow of the invention may be inserted prior to use.

Flexible plastic container 16 is provided and adapted to be filled with a suitable fluid such as water through valve 16A which is then sealed when container 16 is substantially filled. Fluid-filled plastic container 16 is sized so as to fit snugly into recess 14 in the top surface of foam element 12. When fluid-filled plastic container 16 is snugly positioned within recess 14 of resilient foam element 12, the surface of plastic container 16 is substantially coplanar with the top surface of foam element 12. Although plastic container 16 may be formed from other materials, applicants have discovered that plastic container 16 is most suitably formed from conventional fluid impermeable vinyl plastic formed into an envelope as best seen in FIGS. 1, 3 and 4 of the patent drawings. Also, an optional zippered pad 18 as shown in FIG. 5 may be provided as a cover for therapy pillow 10 during use. Zipper 18A allows for slidable insertion of pillow 10 into pad 18 prior to use.

In this fashion, therapy pillow 10 can be used to render sleeping more comfortable for a person suffering from heartburn and/or symptoms which are otherwise known as gastroesophageal reflux disease (GERD). Since this is well known to be a chronic disease, users of therapy pillow 10 will most probably be using the pillow over a long period of time. Moreover, unlike prior art foam wedge pillows that are presently known to one skilled in the art, therapy pillow 10 provides for even weight distribution in order to alleviate well known neck and back stiffness associated with prior art foam wedge pillows.

As shown in the patent drawings, flexible plastic container 16 is adapted such that valve 16A may be opened and water or another suitable fluid poured therethrough to substantially inflate plastic container 16. At that time, valve 16A is shut so as to prevent fluid leakage from plastic container 16 during use of therapy pillow 10. Valve 16A is a pivotable cap-type valve although any suitable valve may be utilized to allow for introduction of a desired fluid into plastic container 16 and subsequent fluid tight sealing of the container.

Although applicant contemplates that therapy pillow 10 may be constructed in many different sizes and dimensions, the following dimensions are suitable for a representative embodiment of therapy pillow 10:

Therapy Pillow Dimensions

Length 36 inches
Width: 30 inches
Height at top: 6 inches
Height at bottom: 2 inches
Depth of planar recess: 2 inches
Width of planar recess: 18 inches
Height of planar recess: 24 inches
Distance between side edge of planar recess and side edge of pillow: 6 inches
Distance between top edge of planar recess and top edge of therapy pillow: 8 inches
Distance between bottom edge of planar recess and front edge of therapy pillow: 4 inches
Width of flexible plastic container: 18 inches
Height of flexible plastic container: 24 inches
Height of fluid-filled flexible plastic container: 1 inches
Metric fluid volume of flexible plastic container: 6 liters The therapy pillow hereinbefore described provides improved support for the upper body of the user and is particularly useful for treating gastroesophageal reflux disease (GERD). The fluid-filled flexible plastic container serves to minimize neck and back stiffness associated with sleeping on a foam wedge pillow by enhanced weight distribution achieved by a fluid-filled flexible plastic container residing in the medial portion of the top surface of the wedge-shaped foam element of the therapy pillow.

The present invention has been described by reference to a preferred embodiment of the invention as shown in the drawings, but various changes can be made to the type of material employed and to the relative positions of the elements which comprise the invention without departing from the spirit and scope thereof. The invention is intended to be limited only by the scope of the claims as set forth hereinbelow.

It will be understood that various details of the invention may be changed without departing from the scope of the invention. Furthermore, the foregoing description is for the purpose of illustration only, and not for the purpose of limitation—the invention being defined by the claims.

What is claimed is:

1. A therapy pillow useful for treating gastroesophageal reflux disease (GERD) and for other applications comprising:

(a) a wedge-shaped resilient foam element having a top and a bottom surface and a relatively elevated first end and a relatively lower second end, said foam element defining a planar recess in the medial portion of the top surface thereof; and (b) a flexible plastic container shaped to snugly fit into the planar recess of said foam element so as to be substantially coplanar with the top surface of said foam element, said container being adapted to sealably receive a fluid therein;

whereby the fluid-filled plastic container serves to distribute weight evenly and minimize neck and back stiffness of a patient sleeping on said therapy pillow.

2. A therapy pillow according to claim 1 wherein said foam element is formed from polyurethane.

3. A therapy pillow according to claim 1 wherein the elevated first end of said foam element is about 6 inches high and the relatively lower second end defines a tapered edge about 2 inches high.

4. A therapy pillow according to claim 3 wherein said therapy pillow is about 36 inches in length from said elevated first end to said relatively lower second end.

5. A therapy pillow according to claim 1 wherein the planar recess in said foam element is about 2 inches below the plane of the top surface thereof.

6. A therapy pillow according to claim 5 wherein said planar recess is about 18 inches wide and about 24 inches high.

7. A therapy pillow according to claim 1 wherein said flexible plastic container is formed from vinyl plastic.

8. A therapy pillow according to claim 7 wherein said flexible plastic container includes a valve therein for introducing fluid thereinto.

9. A therapy pillow according to claim 8 wherein said flexible plastic container is filled with water through said valve therein.

10. A therapy pillow according to claim 1 wherein said therapy pillow includes a cover into which said therapy pillow is inserted.

* * * * *